US009169664B2

(12) United States Patent
Shiraishi

(10) Patent No.: US 9,169,664 B2
(45) Date of Patent: Oct. 27, 2015

(54) ASSEMBLY TENT

(75) Inventor: Tokuhiro Shiraishi, Yokohama (JP)
(73) Assignee: Newtec Japan Co., Ltd., Kanagawa (JP)

( * ) Notice: Subject to any disclaimer, the term of this patent is extended or adjusted under 35 U.S.C. 154(b) by 0 days.

(21) Appl. No.: 14/118,300
(22) PCT Filed: Apr. 9, 2012
(86) PCT No.: PCT/JP2012/059663
§ 371 (c)(1),
(2), (4) Date: Jan. 2, 2014
(87) PCT Pub. No.: WO2012/157372
PCT Pub. Date: Nov. 22, 2012

(65) Prior Publication Data

US 2014/0224290 A1 Aug. 14, 2014

(30) Foreign Application Priority Data

May 19, 2011 (JP) ..... 2011-112090

(51) Int. Cl.
*E04H 15/34* (2006.01)
*E04H 15/48* (2006.01)

(52) U.S. Cl.
CPC ..... *E04H 15/34* (2013.01); *E04H 15/48* (2013.01)

(58) Field of Classification Search
CPC ..... F16B 7/22; F16B 7/042; F16B 7/0413
USPC ..... 135/121, 114, 120.3, 909; 403/292, 403/322.4
See application file for complete search history.

(56) References Cited

U.S. PATENT DOCUMENTS 2,144,747 A * 1/1939 Adams ..... 135/138
2,530,765 A * 11/1950 Greenup ..... 135/98

(Continued)

FOREIGN PATENT DOCUMENTS

JP 57-33783 7/1982
JP 63-35893 9/1988

(Continued)

OTHER PUBLICATIONS

Espacenet bibliographic data for JP3195741 published Aug. 6, 2001, two pages.

(Continued)

*Primary Examiner* — Noah Chandler Hawk
(74) *Attorney, Agent, or Firm* — Rankin, Hill & Clark LLP

(57) ABSTRACT

An object of the present invention is to provide an assembly tent that is easy to assemble, excellent in strength, and capable of being disassembled and compactly accommodated after use. The assembly tent is a tent assembled through coupling of a traverse beam member extending horizontally from two adjacent supporting columns at both ends of a coupling member, wherein coupling between the traverse beam member and the coupling member is formed by inserting, into one member of the traverse beam member and the coupling member, the other member in an axial direction. For establishing the coupling between the traverse beam member and the coupling member, a pin insertion hole is provided to a circumference side wall of the one member of the traverse beam member and the coupling member, a lock mechanism, which biases a lock pin to penetrate the pin insertion hole from an outer circumference side wall and protrude from an inner circumference side wall, is arranged at the outer circumference side wall, and a pin engagement concave portion is arranged at an outer circumference side wall of the other member, such that when the other member is inserted into the one member, the biased lock pin engages with the pin engagement concave portion to lock the coupling between the traverse beam member and the coupling member.

15 Claims, 6 Drawing Sheets

(56) References Cited

U.S. PATENT DOCUMENTS

| | | | | | |
|---|---|---|---|---|---|
| 2,714,387 | A * | 8/1955 | Meldrum | 114/361 |
| 3,282,274 | A * | 11/1966 | Scott | 135/142 |
| 3,424,178 | A * | 1/1969 | Yazaki | 135/157 |
| 3,446,523 | A * | 5/1969 | Little | 403/108 |
| 3,457,930 | A * | 7/1969 | Roy et al. | 135/156 |
| 4,066,089 | A * | 1/1978 | Rainwater | 135/151 |
| 4,329,078 | A * | 5/1982 | Crates et al. | 403/316 |
| 4,558,713 | A * | 12/1985 | Hagler et al. | 135/159 |
| 4,586,399 | A | 5/1986 | Kassai | |
| 4,971,474 | A * | 11/1990 | Sprague | 403/331 |
| 5,127,762 | A * | 7/1992 | Havlovitz | 403/298 |
| 5,144,780 | A * | 9/1992 | Gieling et al. | 52/298 |
| 5,224,507 | A * | 7/1993 | Vosse | 135/138 |
| 5,816,633 | A * | 10/1998 | Odom | 294/51 |
| 6,089,247 | A * | 7/2000 | Price | 135/145 |
| 6,139,214 | A * | 10/2000 | Zirps et al. | 403/325 |
| 6,216,717 | B1 * | 4/2001 | Chen | 135/130 |
| 6,672,792 | B1 * | 1/2004 | Schipani et al. | 403/322.4 |
| 6,892,503 | B1 * | 5/2005 | Kang | 52/653.2 |
| 7,293,934 | B1 * | 11/2007 | Huang | 403/109.1 |
| 7,625,033 | B2 * | 12/2009 | Michelau et al. | 296/177 |
| 7,703,469 | B2 * | 4/2010 | Danziger | 135/147 |
| 8,485,488 | B2 * | 7/2013 | Forrest et al. | 248/408 |
| 8,776,813 | B2 * | 7/2014 | DeLap et al. | 135/114 |

FOREIGN PATENT DOCUMENTS

| | | |
|---|---|---|
| JP | 9-125522 | 5/1997 |
| JP | 3195741 | 8/2001 |

OTHER PUBLICATIONS

Espacenet bibliographic data for JPH09125522 published May 13, 1997, two pages.

International Search Report for corresponding PCT/JP2012/059663 mailed Aug. 14, 2012, two pages.

* cited by examiner

ASSEMBLY TENT

TECHNICAL FIELD

The present invention relates to an assembly tent that is easy to assemble, excellent in strength, and capable of being disassembled and compactly accommodated after use.

BACKGROUND ART

A collapsible tent is known in which two adjacent supporting columns are coupled by a truss frame capable of extension and contraction and the supporting columns are pushed and opened to the left and right to spread a traverse beam structure to thereby easily place the tent (Patent Document 1).

However, the truss frame is configured through coupling of an X-shaped frame in which a bar-shaped frame is pivotally attached with a coupling pin to be freely pivotable, and the collapsible tent with this as the traverse beam structure has not necessarily been sufficient in rigidity with respect to stress from the traverse direction.

There is a conventional assembly tent that is assembled through coupling of a traverse beam member extending horizontally from two adjacent supporting columns of the tent coaxially at both ends of a coupling member (Patent Document 2). By inserting the tip end of a traverse beam member (3) into a socket (18) provided to both ends of a coupling member (4) for coupling between the traverse beam member and the coupling member as shown in FIG. 13, such a tent can be assembled relatively easily, and the rigidity with respect to stress from the traverse direction can be improved to some extent.

However, the traverse beam member easily comes off from the socket since the length of the traverse beam member inserted into the socket is short, and unsteadiness or warpage easily occurs in the coupling between the traverse beam member and the coupling member easily. Since the occurrence of unsteadiness or warpage is significant when the traverse beam member or the coupling member is long, it is common as a measure to employ an approach of attaching a supporting column (2) to the coupling member (4) and supporting the coupling member with the supporting column. However, providing such a supporting column to the coupling member not only complicates assembly of the tent, but also increases the volume to be accommodated upon disassembly and folding after use. Since the weight also increases, carrying around becomes difficult.

Thus, development is desired for an assembly tent having a coupling structure of a traverse beam member and a coupling member that is easy to assemble, excellent in strength, and capable of being disassembled and compactly accommodated after use.

Patent Document 1: Japanese Patent Application Laid-open No. 2009-257080

Patent Document 2: Japanese Patent Application Laid-open No. 2001-303800

DISCLOSURE OF THE INVENTION

A task of the present invention is to provide an assembly tent that is easy to assemble, excellent in strength, and capable of being disassembled and compactly accommodated after use.

As a result of a study conducted by the inventor in order to solve the task, it has been found that a tent easily assembled and high in strength with respect to a force from the traverse direction can be obtained by inserting, into one member of a traverse beam member and a coupling member, the other member for coupling of the traverse beam member extending horizontally from two adjacent supporting columns at both ends of the coupling member. Thus, the present invention has been completed.

That is, the present invention is an assembly tent that is a tent assembled through coupling of a traverse beam member extending horizontally from two adjacent supporting columns at both ends of a coupling member, wherein coupling between the traverse beam member and the coupling member is formed by inserting, into one member of the traverse beam member and the coupling member, the other member in an axial direction.

Further, the present invention is the assembly tent, wherein, for establishing the coupling between the traverse beam member and the coupling member, a pin insertion hole is provided to a circumference side wall of the one member of the traverse beam member and the coupling member, a lock mechanism, which biases a lock pin to penetrate the pin insertion hole from an outer circumference side wall and protrude from an inner circumference side wall, is arranged at the outer circumference side wall, and a pin engagement concave portion is arranged at an outer circumference side wall of the other member, such that when the other member is inserted into the one member, the biased lock pin engages with the pin engagement concave portion to lock the coupling between the traverse beam member and the coupling member.

Further the present invention is the assembly tent, wherein the lock mechanism is configured such that a support shaft is provided to a base attachable to the outer circumference side wall of the one member of the traverse beam member and the coupling member, a swing arm to which the lock pin is fixed is pivotably supported to the support shaft, and a biasing member for biasing the lock pin is arranged at the swing arm, such that the biased lock pin engages with the pin engagement concave portion to lock the coupling between the traverse beam member and the coupling member when the other member is inserted into the one member attached with the lock mechanism, and the lock pin is removed from the pin engagement concave portion to release a lock when the swing arm is pivoted in a counter-bias direction against a biasing force by the biasing member.

Further, the present invention is the assembly tent, wherein the traverse beam member and the coupling member are both cylinder-shaped, and the pin engagement concave portion of the other member of the traverse beam member and the coupling member to be inserted into the one member is a pin engagement groove arranged at a circumference of the outer circumference side wall.

Further, the present invention is the assembly tent, wherein the other member of the traverse beam member and the coupling member to be inserted into the one member is formed through joining of a pin engaging member provided with the pin engagement concave portion to a tip end of a pipe.

Further, the present invention is the assembly tent, wherein the pin engaging member is formed by integral molding of synthetic resin.

Further, the present invention is the assembly tent, wherein an insertion guide member including a taper for guiding insertion of the other member of the traverse beam member and the coupling member is placed at a tip end of the one member.

Further, the present invention is the assembly tent, wherein the assembly tent is assembled by coupling, at both ends of the coupling member, the traverse beam member pivoted and spread from the two supporting columns, and coupling a lower end of a roof structure to each of the supporting columns.

By inserting the other member into the one member of the traverse beam member and the coupling member in the axial direction, the traverse beam member and the coupling member can be coupled reliably without causing unsteadiness or warpage. Thus, the coupling member does not need to be attached with an auxiliary member such as a supporting column for a solution to the unsteadiness or the like in a coupled portion, and the assembly tent that is lightweight and excellent in accommodability can be provided.

By inserting the other member into the one member of the traverse beam member and the coupling member in the axial direction, the lock mechanism activates to lock the coupling. Therefore, the safety of the tent is high, and assembly work for the tent can further be performed easily.

By the traverse beam member and the coupling member being cylinder-shaped and the pin engagement groove for engagement with the lock pin being provided at the circumference of the outer circumference side wall of the member to be inserted, it is possible to lock the coupling merely by inserting the member without considering the directionality. Accordingly, work of inserting while adjusting the direction of the member becomes unnecessary, and assembly work for the tent outdoors can be made easy.

The tent can be divided into three types of parts of the coupling member, the supporting column provided with the traverse beam member, and a roof structure member for compact accommodation. Upon assembly, the traverse beam member pivoted and spread from the supporting column is coupled at both ends of the coupling member, and the lower end of the spread roof structure is coupled to the supporting column. Accordingly, the framework of the tent can be assembled easily.

BEST MODE FOR CARRYING OUT THE INVENTION

An assembly tent according to the present invention will be described below with reference to the drawings.

Figure 1:
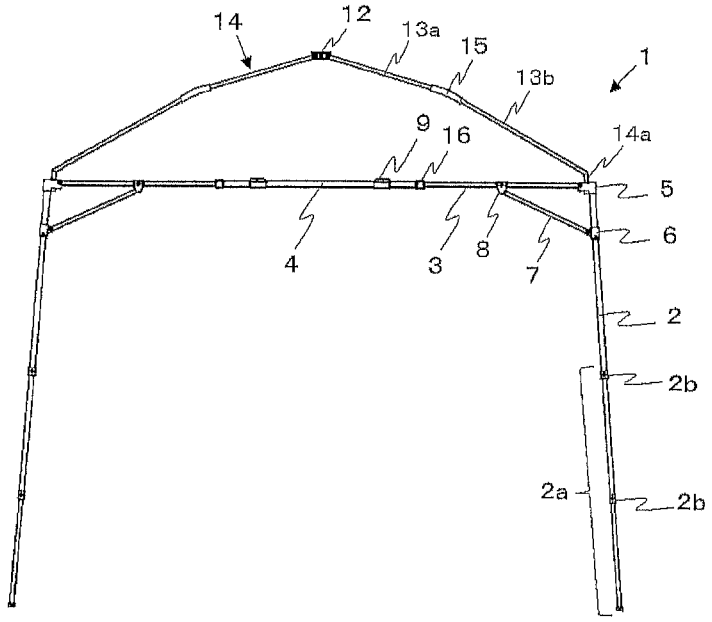
FIG. 1 is an overall view of a framework of an assembly tent.

For the assembly tent, as shown in FIG. 1, a traverse beam member (3) extending horizontally from two adjacent supporting columns (2) is coupled at both ends of a coupling member (4), a plurality of poles (13*a*) coupled to a top joint (12) are spread, and a lower end portion (coupling portion (14*a*)) of a roof structure (14) formed through coupling of an extension pole (13*b*) to each pole (13*a*) with a pole joint (15) is joined to a fixing bracket (5) at the upper end of the supporting column (2) and coupled with the supporting column (2) to form a framework.

Figure 2:
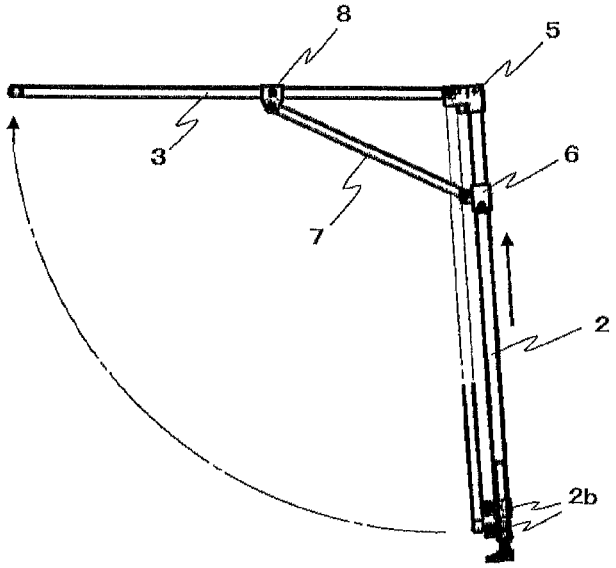
FIG. 2 is a view showing a coupling structure of a supporting column and a traverse beam member.

For the traverse beam member (3), as shown in FIG. 2, the traverse beam member (3) is pivotably attached to the fixing bracket (5) fixed at the upper end of the supporting column (2), and the supporting column and the base end of an auxiliary member (7) are mutually coupled with a slide bracket (6) inserted and attached slidably in the middle of the supporting column. The tip end of the auxiliary member (7) is pivotably coupled in the middle of the traverse beam member (3) by an auxiliary member coupling bracket (8). When the slide bracket (6) is slid upward along the supporting column, the auxiliary member (7) pushes up the traverse beam member (3), and the traverse beam member (3) pivots to spread horizontally.

Figure 3:
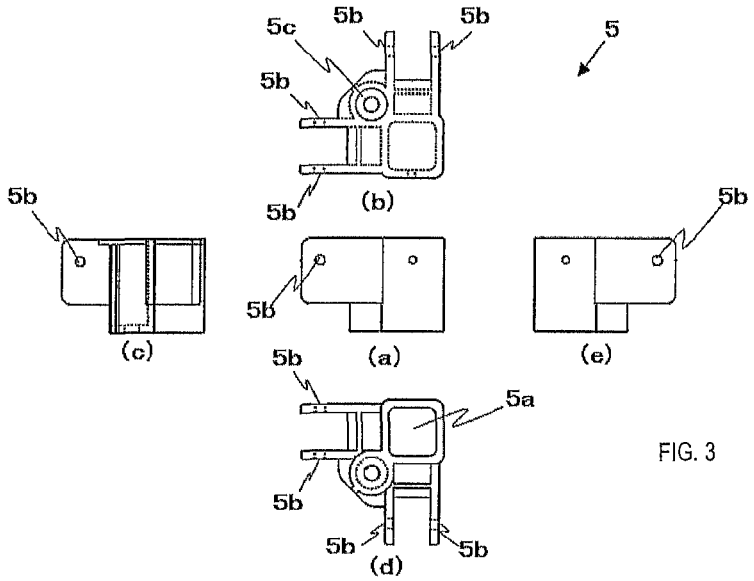
FIG. 3 is a set of views showing the structure of a fixing bracket (FIG. 3(*a*) being a front view, FIG. 3(*b*) a plan view, FIG. 3(*c*) a left side view, FIG. 3(*d*) a bottom view, and FIG. 3(*e*) a right side view)

As shown in FIG. 3, the fixing bracket (5) includes a supporting column inlet hole (5*a*) to which the upper tip end of the supporting column is inlet for fastening at the upper end of the supporting column (2). The fixing bracket (5) includes a traverse beam member pivotal support hole (5*b*). A metal pin is passed through two opposing traverse beam member pivotal support holes (5*b*), and the traverse beam member (3) is pivotably supported with the metal pin (FIG. 2). Further, a roof structure coupling hole (5*c*) is provided at the top surface of the fixing bracket (5). The lower end portion (coupling portion (14*a*)) of an extension pole (13*b*) forming the roof structure (14) is inserted, and the roof structure (14) is fixed to the supporting column (2). Although FIG. 2 shows the state where the fixing bracket is fastened to the upper end of the supporting column, this is not limiting. An arrangement fixed to the upper portion of the supporting column suffices, and fixing may be in a state where, for example, the upper end of the supporting column slightly extends upward beyond the fixing bracket.

Figure 4:
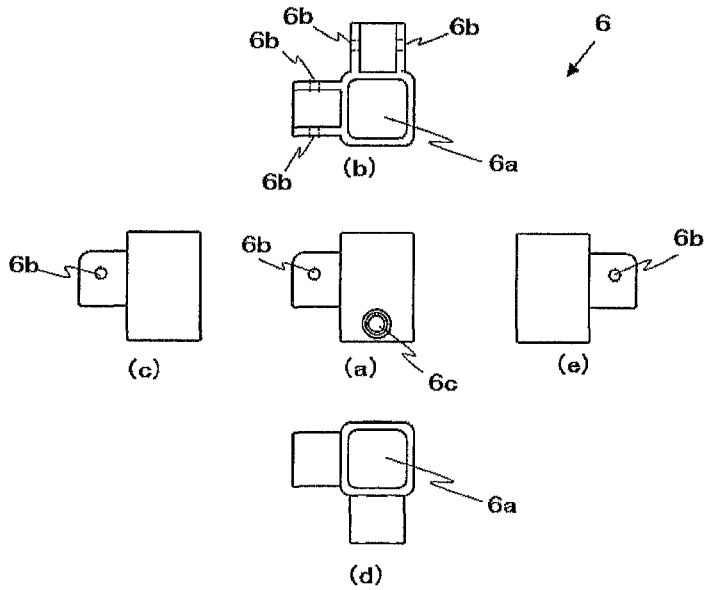
FIG. 4 is a set of views showing the structure of a slide bracket (FIG. 4(*a*) being a front view, FIG. 4(*b*) a plan view, FIG. 4(*c*) a left side view, FIG. 4(*d*) a bottom view, and FIG. 4(*e*) a right side view)

As shown in FIG. 4, the slide bracket (6) includes a supporting column insertion hole (6*a*) for passing the supporting column (2) through and is vertically slidable along the supporting column (2) inserted into the insertion hole (FIG. 2). On the side surface of the slide bracket (6), an auxiliary member pivotal support hole (6*b*) is placed. A metal pin is passed through two opposing auxiliary member pivotal support holes (6*b*), and the base end of the auxiliary member (7)

is pivotably supported with the metal pin (FIG. 2). A lock button (6*c*) is for fixing the slide bracket (6) to the supporting column (2) in a position where the traverse beam member (3) becomes horizontal.

Figure 5:
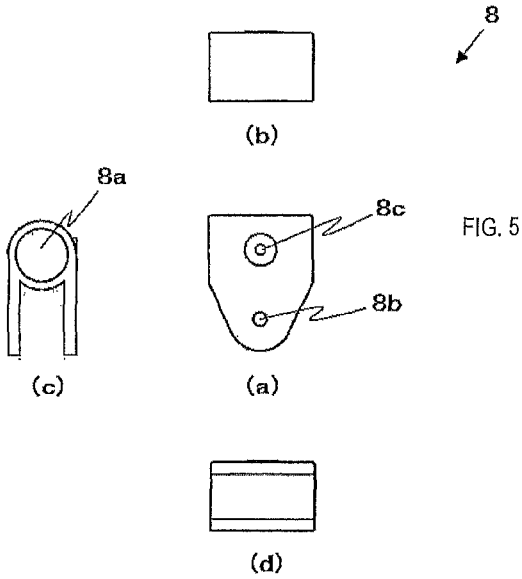
FIG. 5 is a set of views showing the structure of an auxiliary member coupling bracket (FIG. 5(*a*) being a front view, FIG. 5(*b*) a plan view, FIG. 5(*c*) a left side view, and FIG. 5(*d*) a bottom view)

As shown in FIG. 5, the auxiliary member coupling bracket (8) includes a traverse beam member insertion hole (8*a*) for passing the traverse beam member (3) through, and the traverse beam member (3) is inserted into the insertion hole. The side surface of the auxiliary member coupling bracket (8) is provided with a traverse beam member fixing hole (8*c*) into which a helix is screwed, causing pressure contact of the tip end of the helix against the traverse beam member (3) to join the auxiliary member coupling bracket (8) and the traverse beam member (3).

The auxiliary member coupling bracket (8) includes an auxiliary member pivotal support hole (8*b*). A metal pin is passed through two opposing auxiliary member pivotal support holes (8*b*), and the tip end of the auxiliary member (7) is pivotably supported with the metal pin (FIG. 2).

The coupling between the traverse beam member (3) and the coupling member (4) is formed by inserting, into one member of the traverse beam member and the coupling member, the other member in the axial direction. With such coupling, a distance L of insertion of the member can be increased (FIG. 6), and the traverse beam member and the coupling member can be coupled firmly without causing unsteadiness or warpage. Since assembly of the tent is easy and the coupling member does not need support of a supporting column or the like, the accommodation volume after use can be reduced, and the portability is excellent.

The coupling between the traverse beam member and the coupling member may be established by inserting the traverse beam member into the coupling member, or may be established by inserting the coupling member into the traverse beam member. Hereinafter, a case of coupling through insertion of the traverse beam member into the coupling member will be described as an example according to the referenced drawings.

Figure 6:
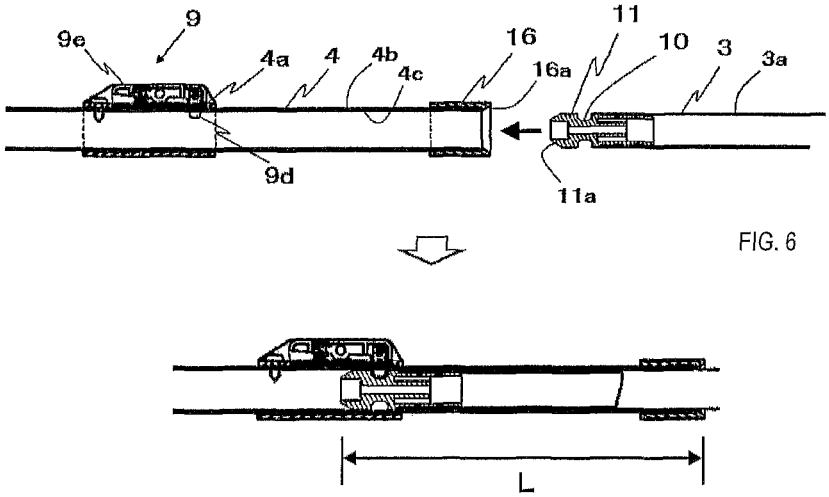
FIG. 6 is a view showing the coupling structure of the traverse beam member and the coupling member.
Figure 8:
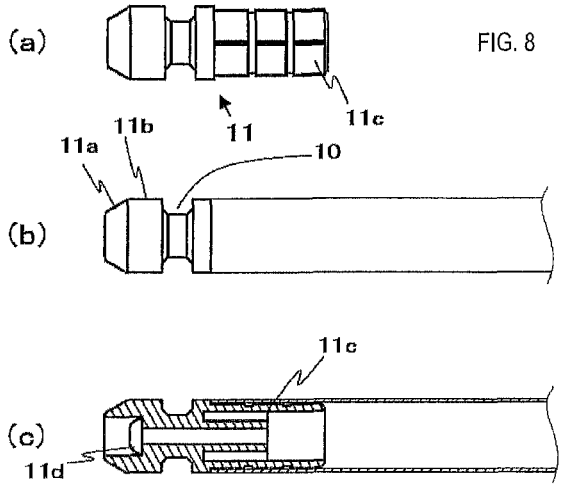
FIG. 8 is a set of views showing the structure of a pin engaging member (FIG. 8(*a*) being a front view of the pin engaging member, FIG. 8(*b*) a view of the state where the pin engaging member and a pipe are joined, and FIG. 8(*c*) a sectional view in the joined state)

FIG. 6 shows the state where the traverse beam member (3) is inserted into and coupled with the coupling member (4) in the axial direction. On the circumference side wall of the coupling member (4), a pin insertion hole (4*a*) for a lock pin (9*d*) to penetrate is provided. A lock mechanism (9) in which the lock pin (9*d*) is biased to penetrate the pin insertion hole (4*a*) from an outer circumference side wall (4*b*) and protrude from an inner circumference side wall (4*c*) is placed at the outer circumference side wall (4*b*). At the tip end of the traverse beam member (3), a pin engaging member (11) provided with the pin engagement concave portion (10) for engagement with the lock pin (9*d*) is placed (FIG. 8).

When inserted into the coupling member (4), the traverse beam member (3) enters into the coupling member while pushing up the lock pin (9*d*) with a taper portion (11*a*) at the tip end of the pin engagement concave portion (10). When the pin engagement concave portion (10) proceeds to the position of the lock pin (9*d*), the biased lock pin (9*d*) fits into the pin engagement concave portion (10), and the lock pin (9*d*) and the pin engagement concave portion (10) are engaged to lock the coupling between the coupling member (4) and the traverse beam member (3).

The coupling member (4) is not particularly limited in shape or the like as long as there is within a hollow portion for inserting the traverse beam member (3). For example, a round pipe or square pipe may be used. The traverse beam member (3) to be inserted does not need a hollow portion, and therefore is not particularly limited aside from being capable of insertion into the coupling member and being a bar-shaped material with a thickness and shape that does not cause much unsteadiness upon insertion. However, in order to reduce the weight in view of portability, it is preferable to use a round pipe or square pipe, for example.

At the tip end of the coupling member (4), an insertion guide member (16) provided with a taper (16*a*) on the inside surface may be provided for ease of insertion of the traverse beam member (3) (FIG. 6).

A length L of the traverse beam member inserted into the coupling member should be appropriately selected depending on the size of the tent or the shape, material, or the like of a bar-shaped member used for the coupling member and the traverse beam member, but is preferably 10 to 50 cm (FIG. 6). When it is shorter than 10 cm, a coupled portion easily warps, and sufficient strength of the tent cannot be expected. When it is longer than 50 cm, the strength of the tent does not pose a problem, but the coupling member and the traverse beam member become longer than necessary. Upon disassembly after use, the volume to be accommodated increases, and the weight increases, making it difficult to carry around.

FIG. 6 shows an example in which the pin engaging member (11) provided with the pin engagement concave portion (10) for engagement with the lock pin (9*d*) is placed at the tip end of the traverse beam member (3). However, this is not necessarily limiting. For example, instead of using the pin engaging member (11), a concave portion for engagement with a lock pin may be provided as the pin engaging member at an outer circumference side wall (3*a*) of the traverse beam member (3), and this concave portion may be used as the pin engagement concave portion.

Figure 7:
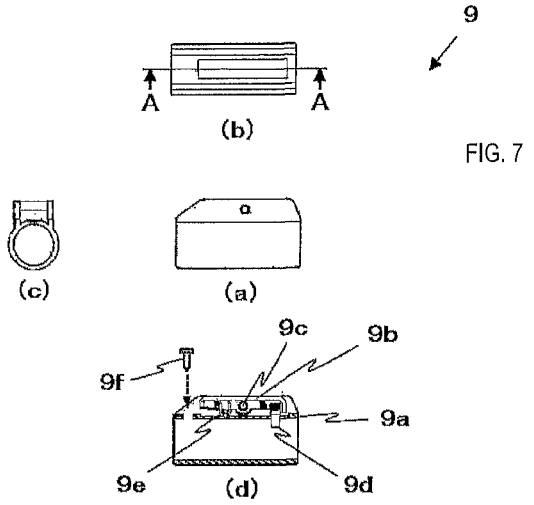
FIG. 7 is a set of views showing the structure of a lock mechanism (FIG. 7(*a*) being a front view, FIG. 7(*b*) a plan view, FIG. 7(*c*) a left side view, and FIG. 7(*d*) a sectional view along line A-A)

In the lock mechanism (9), as shown in FIG. 7, a support shaft (9*c*) is provided to a base (9*a*) attachable to the outer circumference side wall (4*b*) of the coupling member (4), a swing arm (9*b*) to which the lock pin (9*d*) is fixed is pivotably supported to the support shaft, and a spring (9*e*) for biasing the lock pin (9*d*) is arranged at the swing arm (9*b*), such that the biased lock pin (9*d*) engages with the pin engagement concave portion (10) to lock the coupling between the traverse beam member (3) and the coupling member (4) when the traverse beam member (3) is inserted into the coupling member (4) attached with the lock mechanism (9). When the swing arm (9*b*) is pivoted in the counter-bias direction against the biasing force by the spring (9*e*), the lock pin (9*d*) is removed from the pin engagement concave portion (10), and the lock can be released. The lock mechanism (9) is placed at the outer circumference side wall (4*b*) of the coupling member (4) and fixed by a fixing bolt (9*f*).

FIG. 8 shows the pin engaging member (11) that is arranged at the tip end of the traverse beam member (3) and for engagement with the lock pin. As shown in the drawing, the pin engaging member (11) includes the taper portion (11*a*), a flat portion (11*b*), and the pin engagement concave portion (10), and enters while pushing up the lock pin (9*d*) with the taper portion (11*a*) upon insertion of the traverse beam member (3) into the coupling member (4). When, the pin engagement concave portion (10) enters up to the position of the lock pin (9*d*), the biased lock pin (9*d*) fits into the concave portion (10), and the lock pin (9*d*) and the pin engagement concave portion (10) are engaged. The flat portion (11*b*) is not necessarily needed. However, when the pin engagement concave portion is directly next to the taper portion without the flat portion, the rear end of the taper portion becomes acute, and a wear or deformation due to repeated use or contact with another member easily occurs. The flat portion eliminates an acute portion on the outside surface and prevents such adverse effects.

It may be such that the coupling member (4) and the traverse beam member (3) are cylinder-shaped as in a round pipe, and a pin engagement concave groove (10) for engagement with the lock pin (9*d*) is provided at the circumference of the outer circumference side wall (4*b*) of the traverse beam member (4). FIG. 8 shows an example in which the traverse beam member is formed by attaching the pin engaging member (11) including the pin engagement groove at the outer circumference to the tip end of a round pipe. The pin engaging member has an outer diameter that is approximately the same diameter as the outer diameter of the round pipe, and is provided with the pin engagement concave groove (10) at the circumference of an outer circumference side wall. By causing the coupling member (3) and the traverse beam member (4) to be in such a shape, it is possible to lock the coupling through insertion of the traverse beam member into the coupling member without considering the directionality. Accordingly, work of twisting and adjusting the direction of the traverse beam member for insertion into the coupling member in the state where the supporting column is coupled as shown in FIG. 2 becomes unnecessary, and assembly work for the tent outdoors can be made easy.

The pin engaging member (11) is not particularly limited, but preferably integrally molded by synthetic resin. This is because being formed of synthetic resin provides elasticity and makes it easier for a fitting portion (11*c*) to be fit into and fixed at the tip end of the pipe, and being integrally molded provides excellent strength and improves productivity. By screwing a fixing bolt (11*d*) from the tip end of the pin engaging member (11) after the fitting into the pipe, the outer diameter of the fitting portion (11*c*) can be enlarged to cause firm contact with the inner circumference side surface of the pipe, so that joining with the pipe is reliable.

Figure 9:
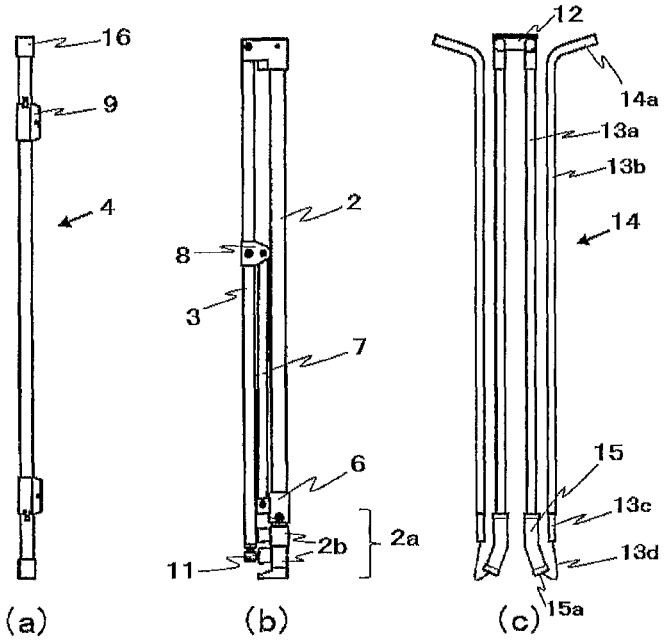
FIG. 9 is a set of views showing the state where the framework of the tent is disassembled (FIG. 9(*a*) being the coupling member, FIG. 9(*b*) the supporting column provided with the traverse beam member, and FIG. 9(*c*) a roof structure)

FIG. 9 shows three types of divided parts before assembly or after use of the tent. A rectangular-shaped tent including four supporting columns can be assembled by using (a) four coupling members (4), (b) four supporting columns (2) provided with the traverse beam member (3), and (c) one roof structure (14).

Figure 10:
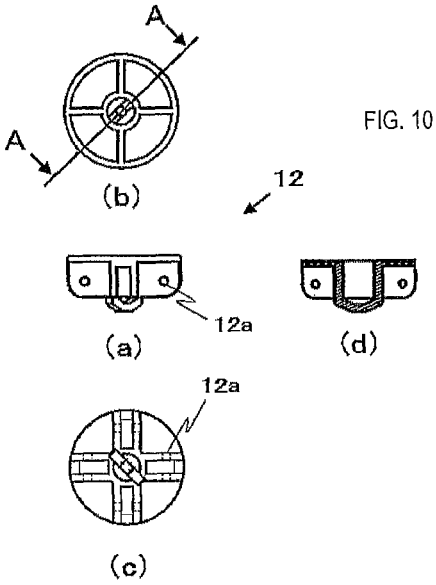
FIG. 10 is a set of views showing the structure of a top joint (FIG. 10(*a*) being a front view, FIG. 10(*b*) a plan view, FIG. 10(*c*) a bottom view, and FIG. 10(*d*) a sectional view along line A-A)
Figure 11:
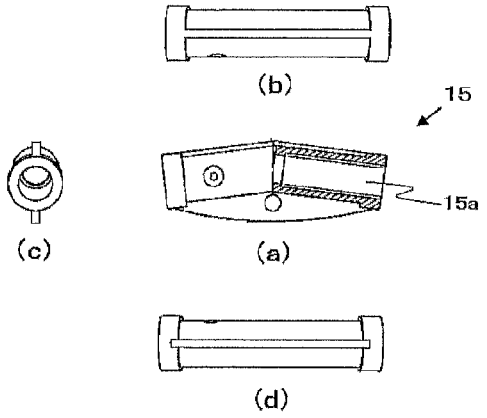
FIG. 11 is a set of views showing the structure of a pole joint (FIG. 11(*a*) being a front partial sectional view, FIG. 11(*b*) a plan view, FIG. 11(*c*) a left side view, and FIG. 11(*d*) a bottom view)

The roof structure (14) is assembled through spreading of the four poles (13*a*) mutually coupled via the top joint (12) and coupling of the tip end of the extension pole (13*b*) to the lower end of each pole (13*a*). The top joint (12) includes eight pole pivotal support holes (12*a*) (FIG. 10). A metal pin is passed through two opposing pole pivotal support holes (12*a*), and the pole (13*a*) is pivotably supported with the metal pin, such that four poles (13*a*) are coupled. At the lower end of the pole (13*a*), the pole joint (15) for coupling of the extension pole (13*b*) is joined. The pole joint (15) is provided with an insertion hole (15*a*) into which an inlet portion (13*c*) at the tip end of the extension pole (13*b*) is inserted for coupling between the pole (13*a*) and the extension pole (13*b*). A coupling chord (13*d*) is a string-shaped member of an elastic material such as rubber. One end thereof is joined to the inside surface of a pipe of the extension pole (13*b*), and the other end is joined to the inside surface of the pole joint (15) to prevent loss of the extension pole. Upon assembly, there is elastic recoil for accommodation inside the pipe of the extension pole (13*b*).

Figure 12:
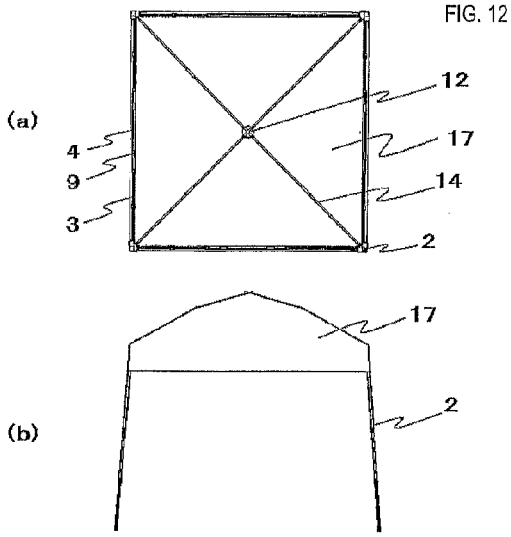
FIG. 12 is a set of overall views of the assembly tent (FIG. 12(*a*) being a bottom view and FIG. 12(*b*) a front view)
Figure 13:
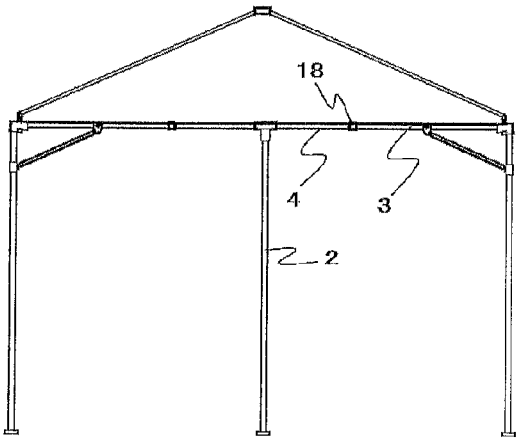
FIG. 13 is a conventional assembly tent.

A method of assembling the tent is to first slide the slide bracket (6) of the supporting column (2) upward along the supporting column to push up the traverse beam member (3) with the auxiliary member (7) coupled to the slide bracket and spread the traverse beam member (3) horizontally. The tip end of the traverse beam member (3) is inserted into the coupling member (4) so that the traverse beam member and the coupling member are coupled and the framework on the side surface of the tent is built. By the coupling member (3) and the traverse beam member (4) being a round pipe, the lock mechanism (9) being attached to the coupling member (3), the pin engaging member (11) being attached to the tip end of the traverse beam member (4), and the pin engagement concave groove (10) being provided at the circumference of the outer circumference side wall, locking is possible merely by inserting the traverse beam member (4) into the coupling member (3) regardless of directionality, and a traverse beam portion of the tent can be assembled quickly. Next, the coupling portion (14*a*) (corresponding to the lower end portion of the extension pole (13*b*)) of the assembled roof structure (14) is fit into the roof structure coupling hole (5*c*) of the fixing bracket (5) to complete the framework of the tent (FIG. 1). The supporting column (2) accommodates, inside a pipe, an inner pipe (extension mechanism portion (2*a*)) for extension. By holding and pulling out an extension joint portion (2*b*) that is at the tip end of each inner pipe, the supporting column (2) can be extended. After attaching an awning (17) to the framework of the tent, the supporting column (2) is extended to complete the tent (FIG. 12)

EXPLANATION OF REFERENCE NUMERALS

1 Assembly tent
2 Supporting column
3 Traverse beam member
3*a* Outer circumference side wall
4 Coupling member
4*a* Pin insertion hole
4*b* Outer circumference side wall
4*c* Inner circumference side wall
5 Fixing bracket
5*a* Supporting column inlet hole
5*b* Traverse beam member pivotal support hole
5*c* Roof structure coupling hole
6 Slide bracket
6*a* Supporting column insertion hole
6*b* Auxiliary member pivotal support hole
6*c* Lock button
7 Auxiliary member
8 Auxiliary member coupling bracket
8*a* Traverse beam member insertion hole
8*b* Auxiliary member pivotal support hole
8*c* Traverse beam member fixing hole
9 Lock mechanism
9*a* Base
9*b* Swing arm
9*c* Support shaft
9*d* Lock pin
9*e* Spring (biasing member)
9*f* Fixing bolt
10 Pin engagement concave portion (pin engagement groove)
11 Pin engaging member
11*a* Taper portion
11*b* Flat portion
11*c* Fitting portion
11*d* Fixing bolt
12 Top joint
12*a* Pole pivotal support hole
13 Pole
13*a* Pole
13*b* Extension pole
13*c* Inlet portion
13*d* Coupling chord
14 Roof structure

14*a* Coupling portion
15 Pole joint
15*a* Insertion hole
16 Insertion guide member
16*a* Taper
17 Awning
18 Socket

The invention claimed is:

1. An assembly tent comprising four supporting columns, eight traverse beam members and four coupling members, two of the traverse beam members being pivotably attached to each of the supporting columns, two of the traverse beam members being coupled with each of the coupling members, the tent assembled through coupling of the traverse beam members extending horizontally from two of the adjacent supporting columns at both ends of the coupling member, wherein coupling between the traverse beam member and the coupling member is formed by inserting, into one member of the traverse beam member and the coupling member, the other member in an axial direction, the one member comprises an insertion guide member arranged at a tip end of the one member and a lock mechanism arranged at an outer circumference side wall of the one member and arranged apart from the insertion guide member in the axial direction, the other member comprises a pin engaging member arranged at a tip end of the other member and having a cylinder shape, the pin engaging member comprising a pin engagement annular concave portion extending around an entire outer circumference side wall of the pin engaging member and a flat portion arranged closer to the tip end of the other member than the pin engagement annular concave portion, the traverse beam member and the coupling member are both cylinder-shaped pipes, an inner diameter of the one member is larger than an outer diameter of the other member and an outer diameter of the pin engaging member is the same as the outer diameter of the other member so that the other member and the pin engaging member are inserted into the one member and the pin engaging member is engaged with the lock mechanism arranged apart from the insertion guide member in the axial direction, the assembly tent further comprises a slide bracket and an auxiliary member, the slide bracket being slidably attached to each of the supporting columns, a base end of the auxiliary member being coupled with the slide bracket and a tip end of the auxiliary member being coupled with the traverse beam member, two of the traverse beam members are pivotably spread by sliding the slide bracket upward along the supporting column to push up the traverse beam member with the auxiliary member, and the pin engagement annular concave portion is positioned inside of the one member when the traverse beam member and the coupling member are coupled.

2. The assembly tent according to claim 1, wherein, for establishing the coupling between the traverse beam member and the coupling member, a pin insertion hole is provided to the outer circumference side wall of the one member of the traverse beam member and the coupling member, and the lock mechanism biases a lock pin to penetrate the pin insertion hole from the outer circumference side wall of the one member and protrude from an inner circumference side wall of the one member, and such that when the other member is inserted into the one member, the biased lock pin engages with the pin engagement annular concave portion to lock the coupling between the traverse beam member and the coupling member.

3. The assembly tent according to claim 2, wherein the pin engagement annular concave portion of the other member of the traverse beam member and the coupling member to be inserted into the one member is a pin engagement annular groove extending around an entire circumference of the outer circumference side wall of the pin engaging member.

4. The assembly tent according to claim 2, wherein the insertion guide member includes a taper for guiding insertion of the other member of the traverse beam member and the coupling member, the taper being placed at the tip end of the one member.

5. The assembly tent according to claim 2, wherein the assembly tent is assembled by coupling, at both ends of the coupling member, the traverse beam member pivoted and spread from the two supporting columns, and coupling a lower end of a roof structure to each of the supporting columns.

6. The assembly tent according to claim 1, wherein the lock mechanism is configured such that a support shaft is provided to a base attachable to the outer circumference side wall of the one member of the traverse beam member and the coupling member, a swing arm to which the lock pin is fixed is pivotably supported to the support shaft, and a biasing member for biasing the lock pin is arranged at the swing arm, such that the biased lock pin engages with the pin engagement annular concave portion to lock the coupling between the traverse beam member and the coupling member when the other member is inserted into the one member attached with the lock mechanism, and the lock pin is removed from the pin engagement annular concave portion to release a lock when the swing arm is pivoted in a counter-bias direction against a biasing force by the biasing member.

7. The assembly tent according to claim 6, wherein the insertion guide member includes a taper for guiding insertion of the other member of the traverse beam member and the coupling member, the taper being placed at the tip end of the one member.

8. The assembly tent according to claim 6, wherein the assembly tent is assembled by coupling, at both ends of the coupling member, the traverse beam member pivoted and spread from the two supporting columns, and coupling a lower end of a roof structure to each of the supporting columns.

9. The assembly tent according to claim 1, wherein the pin engagement annular concave portion of the other member of the traverse beam member and the coupling member to be inserted into the one member is a pin engagement annular groove extending around an entire circumference of the outer circumference side wall of the pin engaging member.

10. The assembly tent according to claim 9, wherein the assembly tent is assembled by coupling, at both ends of the coupling member, the traverse beam member pivoted and spread from the two supporting columns, and coupling a lower end of a roof structure to each of the supporting columns.

11. The assembly tent according to claim 1, wherein the pin engaging member is formed by integral molding of synthetic resin.

12. The assembly tent according to claim 11, wherein the assembly tent is assembled by coupling, at both ends of the coupling member, the traverse beam member pivoted and spread from the two supporting columns, and coupling a lower end of a roof structure to each of the supporting columns.

13. The assembly tent according to claim 1, wherein the insertion guide member includes a taper for guiding insertion of the other member of the traverse beam member and the coupling member, the taper being placed at the tip end of the one member.

14. The assembly tent according to claim 13, wherein the assembly tent is assembled by coupling, at both ends of the coupling member, the traverse beam member pivoted and spread from the two supporting columns, and coupling a lower end of a roof structure to each of the supporting columns.

15. The assembly tent according to claim 1, wherein the assembly tent is assembled by coupling, at both ends of the coupling member, the traverse beam member pivoted and spread from the two supporting columns, and coupling a lower end of a roof structure to each of the supporting columns.

* * * * *